US006515587B2

(12) United States Patent
Herbert

(10) Patent No.: US 6,515,587 B2
(45) Date of Patent: Feb. 4, 2003

(54) PACKAGING PROVIDED WITH MEANS TO CHECK INTEGRITY THEREOF

(75) Inventor: Raymond John Herbert, Leigh-on-Sea (GB)

(73) Assignee: Neopost Limited, Romford (GB)

( * ) Notice: Subject to any disclaimer, the term of this patent is extended or adjusted under 35 U.S.C. 154(b) by 0 days.

(21) Appl. No.: 09/770,615

(22) Filed: Jan. 29, 2001

(65) Prior Publication Data

US 2001/0010494 A1 Aug. 2, 2001

(30) Foreign Application Priority Data

Jan. 29, 2000 (GB) ..... 0001975

(51) Int. Cl.[7] ..... G08B 13/00
(52) U.S. Cl. ..... 340/550; 109/42
(58) Field of Search ..... 340/541, 550; 109/38, 42; 705/60–62, 401

(56) References Cited

U.S. PATENT DOCUMENTS

| | | | | |
|---|---|---|---|---|
| 3,633,194 A | * | 1/1972 | Kothe | 340/550 |
| 3,763,795 A | * | 10/1973 | Wetz, Jr. | 109/38 X |
| 3,952,295 A | * | 4/1976 | Luisada et al. | 206/459.1 |
| 4,578,670 A | * | 3/1986 | Joergensen | 340/550 |
| 4,754,629 A | * | 7/1988 | Allen | 109/42 X |
| 4,785,743 A | * | 11/1988 | Dalphin | 109/42 X |
| 4,852,502 A | * | 8/1989 | Klingberg et al. | 109/42 X |
| 4,999,608 A | * | 3/1991 | Galomb | 340/550 |
| 5,049,704 A | * | 9/1991 | Matouschek | 340/550 X |
| 5,506,566 A | * | 4/1996 | Oldfield et al. | 340/550 |
| 5,568,124 A | * | 10/1996 | Joyce et al. | 340/550 |
| 6,215,397 B1 | * | 4/2001 | Lindskog | 340/550 |

FOREIGN PATENT DOCUMENTS

| | | |
|---|---|---|
| EP | 0347209 | 12/1989 |
| GB | 2 220 513 A | 1/1990 |
| GB | 2 258 075 A | 1/1993 |
| GB | 2293046 | 3/1996 |
| GB | 2 297 540 A | 8/1996 |
| GB | 2 306 034 A | 4/1997 |

OTHER PUBLICATIONS

International Search Report, Jun. 2000.

* cited by examiner

*Primary Examiner*—Thomas Mullen
(74) *Attorney, Agent, or Firm*—Shoemaker and Mattare

(57) ABSTRACT

A construction of packaging such as an envelope is disclosed that comprises a wall surrounding contents of the packaging and electrically conductive tracks extending over the wall. An electronic control device is mounted to the wall and includes a plurality of output ports to which one end of each conductive track is connected and an input port to which an opposite end of the conductive tracks are connected. The control device outputs from the output ports pulses which are distinguished from one another and monitors the input port for receipt of these pulses to provide an indication of integrity of the wall of the package.

13 Claims, 2 Drawing Sheets

PACKAGING PROVIDED WITH MEANS TO CHECK INTEGRITY THEREOF

BACKGROUND OF THE INVENTION

This invention relates to packaging for articles in which the packaging is provided with means to check the integrity thereof and in particular relates to mailing envelopes provided with electronic means for monitoring and checking the integrity of the envelope.

In the course of handling articles contained in packaging, the packaging may be subject to damage, either accidental or deliberate. In the event of accidental damage to the packaging the article contained therein may itself become exposed to potential damage. Deliberate damage to packaging may be due to an illegal intent to remove the article from the packaging. An example of an article contained in packaging is a mail piece comprising a mail insert contained in a mailing envelope. It is desirable to be able to monitor the integrity of the packaging of a package during handling thereof to enable detection of the occurrence of damage. Generally, damage is only detected by manual inspection of packages as they pass through a handling system. Damage may not be detected when it occurs and may not be detected until some considerable time after occurrence thereof. As a result it may be difficult to determine where and when the damage to a package occurred during the passage of the package through the handling system and to ascertain the cause of the damage. Detection of occurrence of damage would enable removal of a damaged package from a stream of packages very soon after occurrence of the damage so that the possibility of further damage or of loss of and damage to contents of the package would be reduced.

SUMMARY OF THE INVENTION

According to a first aspect of the invention packaging including a wall to extend around and enclose contents to be contained in the packaging includes a group of electrically conductive first tracks extending over the wall; an electronic control circuit secured to the wall and including a group of output ports and an input port; a first end of each of said group of electrically conductive tracks connected respectively one to each said output port; a second end, opposite to said first end, of each of said first tracks connected to said input port; and said electronic control circuit being operative to output 10 electrical pulses from each said output port, the pulses output from each port being distinguished from pulses output from others of said output ports; said electronic control circuit being responsive to absence of receipt of pulses from any of the output ports via the conductive tracks to provide an indication of occurrence of damage to said wall.

According to a second aspect of the invention a mailing envelope comprises packaging as hereinbefore defined.

According to a third aspect of the invention a blank comprises a sheet of paper or cardboard bearing conductive tracks and an electronic control circuit to form packaging as hereinbefore defined.

According to a fourth aspect of the invention a package handling system for handling packages including the above-described packaging, includes communication means operative to communicate with the electronic control circuits of the packages during passage of the packages through the package handling system.

BRIEF DESCRIPTION OF THE DRAWING

An embodiment of the invention will be described hereinafter by way of example with reference to the drawings in which.

DESCRIPTION OF THE PREFERRED EMBODIMENT

Figure 1:
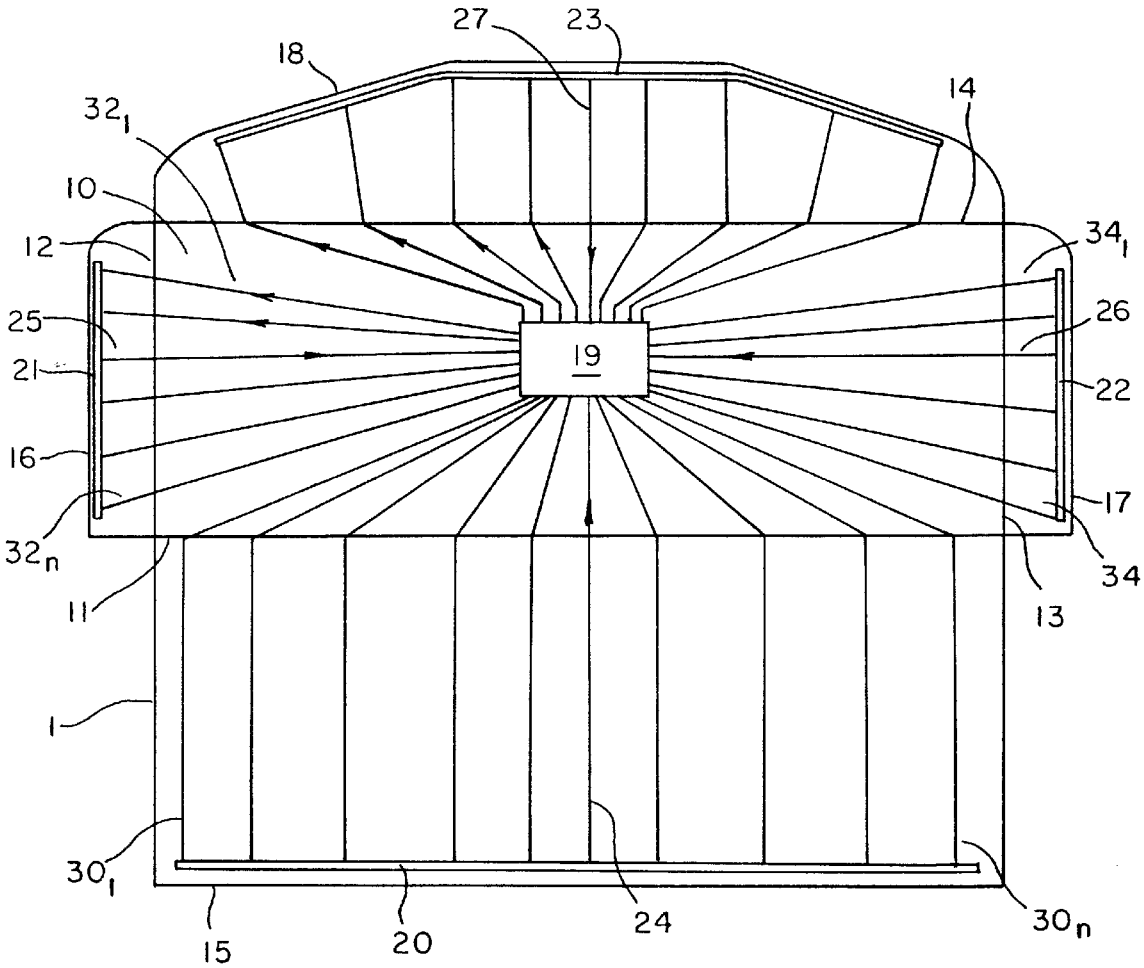
FIG. 1 illustrates a blank for a mailing envelope prior to folding and gluing to form an envelope.

Referring first to FIG. 1, a blank 1 of paper to be folded and glued to form a mailing envelope includes a front section 10 bounded by a lower fold line 11, a first side fold line 12, a second side fold line 13 and an upper fold line 14. A rear section 15 extends from the lower fold line 11, a first side section 16 extends from the first side fold line 12, a second side section 17 extends from the second side fold line 13 and a flap 18 extends from the upper fold line 14. As is well known in the construction of mailing envelopes, the blank is folded on the fold lines 12, 13 so that the first and second side section 16, 17 overlie the front section 10 and then the blank is folded on fold line 11 so that the rear section 15 overlies the front section 10 and the first and second side sections 16, 17. Prior to folding of the blank, adhesive is applied to the side sections or to the rear section in such manner that, after folding, the rear section adheres to the side sections. The flap is provided with a coating of adhesive so that a user of the envelope, after folding the flap about the fold line 14 to bring the flap adjacent the rear section, may seal the flap 18 to the rear section 15.

To enable the integrity of the envelope of a mail piece to be monitored during handling of the mail piece so that occurrence of damage to the mail piece is detected, the envelope is provided with an integrity circuit.

Figure 2:
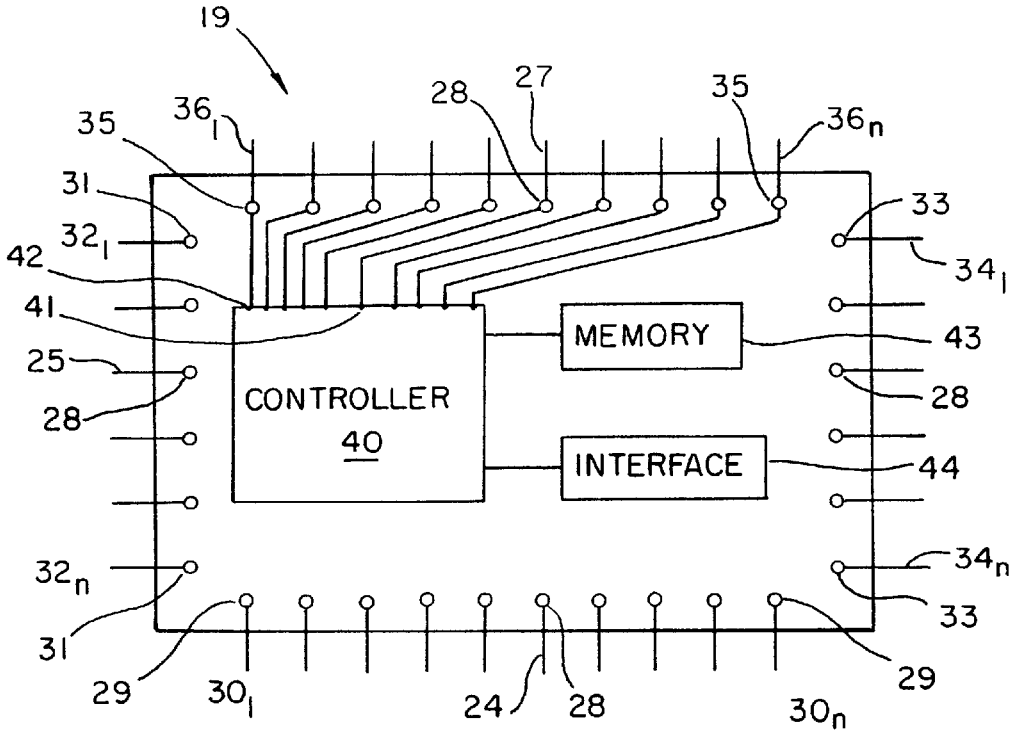
FIG. 2 is a block diagram of an electronic digital device for monitoring integrity of the envelope.
Figure 3:
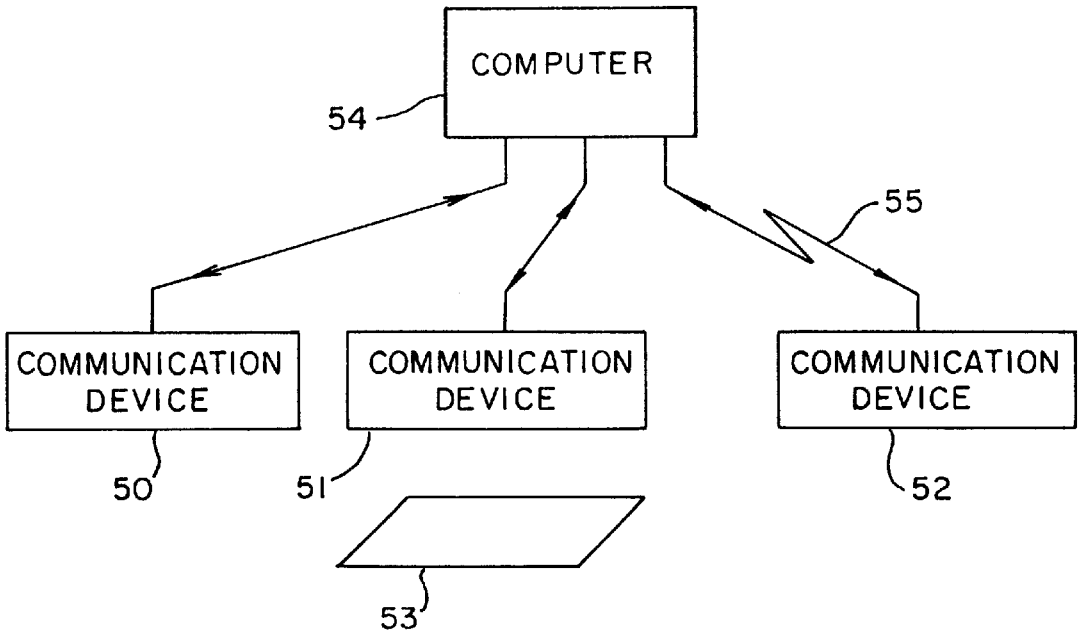
FIG. 3 is a block diagram illustrating a system for handling mail pieces or other packages and for monitoring integrity of the mail pieces or other packages during handling thereof.

The integrity circuit comprises an electronic control device 19 connected via conductive tracks to conductive strips 20, 21, 22, 23. Reference is now made also to FIG. 2 which illustrates the control device.

The conductive strips 20, 21, 22, 23 extend respectively adjacent edges of the rear section 15, the first and second side section 16, 17 and the flap 18. The conductive strips 20, 21, 22, 23 are connected respectively by conductive tracks 24, 25, 26, 27 to different ones of a plurality of input terminals 28. The conductive strip 20 is connected to respective ones of a group of output terminals 29 by conductive tracks $\mathbf{30}_1$–$\mathbf{30}_n$. Similarly the conductive strip 21 is connected to output terminals 31 by conductive tracks $\mathbf{32}_1$–$\mathbf{32}_n$, the conductive strip 22 is connected to output terminals 33 by conductive tracks $\mathbf{34}_1$–$\mathbf{34}_n$ and the conductive strip 23 is connected to output terminals 35 by conductive tracks $\mathbf{36}_1$–$\mathbf{36}_n$. Thus each output terminal of a group is connected by separate conductive tracks to one of the conductive strips and the conductive strip is connected to one input terminal. For clarity in the drawings, only a number of the conductive tracks and of the output terminals are shown but it is to be understood that this is for purposes of illustration only and that a greater or lesser number of conductive tracks and corresponding terminals may be provided.

As illustrated in the block diagram of FIG. 2, the control device 19 includes a controller 40 having a plurality of groups of output ports and a plurality of input ports. The output ports are connected to respective ones of the output terminals and the input ports are connected to respective one of the input terminals. For clarity in FIG. 2 connections are shown only in respect of a connection between terminal 28 and one input port 41 and between the terminals 35 of one group of terminals and one group of the output ports 42 of the controller 40. However it is to be understood that the other terminals 28 are connected to different input ports and the terminals 29, 31 and 33 also are connected respectively to output ports of three groups of output ports of the controller.

In operation the controller 40 generates pulses which are output from the output ports and are transmitted via the conductive tracks to the conductive strips and then are returned via conductive tracks connected to the input ports. For example the controller device generates pulses which are output from a group of output ports and transmitted respectively via the conductive tracks $\mathbf{36}_1$–$\mathbf{36}_n$ to the conductive strip 23 and these pulses are returned via the conductive track 27 to one of the input ports of the controller. The pulses output from the output ports of a group are distinguished from one another. For example the timing of output of the pulses may be different for each output port or pulse code modulation may be utilised to distinguish the outputs from each output port of a group. When a pulse is output from an output port the controller expects to receive back the same pulse after transmission along a conductive a track, a conductive strip and a further conductive track at one of the input ports corresponding to group of output ports from which the pulse was transmitted. Thus if a pulse is output from an output port onto conductive track $\mathbf{36}_1$ it will be expected that the pulse will be received back from conductive track 23 via the conductive track 27 and the terminal 28 by the input port connected to the terminal 28.

A pulse is received as an input in response to each output pulse only if the conductive tracks and conductive strips connected to a group of output ports and to a corresponding input port are entire and are not fractured. However if damage has occurred to the envelope such as to fracture any part of the conductive tracks or conductive strips, at least one of the pulses output by the controller will not be received back at the corresponding input port thereby providing an indication that damage has occurred.

As described hereinbefore the pulses output from any one group of output ports to a corresponding one of the conductive strips via a group of conductive tracks are distinguished from one another. If desired the pulses output from different groups of output ports may be distinguished from one another or the pulses output from different groups of output ports may be the same.

The conductive tracks are distributed over the area of the envelope blank 1 in such a manner that significant damage to any part of the envelope will result in fracture of at least one of the conductive tracks or conductive strips. The adhesive used to adhere the rear section to the side sections and the flap to the rear section is chosen such that the adherence is of sufficient strength that, if an attempt is made to open the envelope at any of the adhesive joints between sections of the envelope, the conductive tracks or conductive strips will be fractured. Accordingly if there is damage to the paper blank from which the envelope is formed or if there is breakage of an adhesive bond between sections of the envelope, at least one of the conductive tracks or conductive strips will be fractured so that at least one of the pulses output by the controller will not be received back by the controller. The lack of reception of a pulse indicates occurrence of damage to the envelope and recognition of which pulse has not been received back provides an indication of the location on the envelope of the damage that has occurred.

The integrity device may include a memory 43 connected to the controller 40. In response to absence of a received pulse, the controller may be arranged to write information to the memory representing the occurrence of the damage and which of the pulses has not been received by the controller thereby providing an indication of the location on the envelope of the damage. If the controller is responsive to real time signals, the controller may write date and time information to the memory to enable the approximate time of detection of damage to be determined. Alternatively or in addition, if the controller is responsive to a current location of the envelope in a mail handling system, the controller may write location information to the memory to enable the location at which the damage was detected to be determined.

The integrity device may include a memory 43 connected to the controller 40. In response to absence of a received communication link 55 to the control computer and which is operated by postal delivery or collection personnel. Upon detection of damage to the packaging of a package, the integrity circuit operates to store an indication of the occurrence of damage in the memory and this indication is read from the memory when the controller is in communication with a communication device of the system. In response to the control computer 54 receiving information that damage has occurred to a package in the handling system, means may be operated by the control computer to segregate or to enable segregation of the damaged package from the stream of packages in the system.

The paper of which the envelope blank 1 is formed is electrically non-conductive and hence conductive tracks and conductive strips may be formed by deposition of electrically conductive material on a surface of the paper of which the envelope blank 1 is formed. Similarly the control device 19 and semiconductor components thereof may be produced on the surface of the paper blank. It is preferred that the semiconductors are polymer semi-conductors because such semiconductors are readily formed by deposition and are able to flex with flexing of the paper forming the envelope. The tracks, the strips and the semiconductor components may be produced by screen printing or other deposition processes. To prevent accidental damage to the integrity circuit itself, it is preferred that the conductive strips, the conductive tracks and the control device be formed on a surface of the paper blank that is to be interior in the finished envelope. If desired to prevent accidental damage to the integrity circuit during insertion of inserts into the envelope, the components of the integrity circuit may be protected by a layer of paper or other insulating material extending over the components. The layer of paper may be of sufficient extent to cover the conductive tracks, conductive strips and the components of the control device or may be co-extensive with the paper blank 1 so that the envelope is formed of a composite comprising two paper layers bonded together with the integrity circuit extending on a surface of one of the layers that, in the envelope blank extends internally of the composite.

While hereinbefore the invention has been described as applied to packaging in the form of a mailing envelope and to the detection of the occurrence of damage to mail pieces, it is to be understood that the invention may be applied to other forms of packaging including containers, for example cardboard boxes for parcels, formed from cardboard or like material.

I claim:

1. Packaging, including:

a wall to extend around and enclose contents to be contained in the packaging;

a group of electrically-conductive tracks extending over the wall, each including a first end and a second end opposite to the first end; and an electronic control circuit secured to the wall and including a group of first, output ports and a second, input port, the output ports being connected to respective ones of the first ends of the electrically-conductive tracks and the input port being connected to the second ends of the electrically-conductive tracks;

wherein the electronic control circuit is operative to output electrical pulses from each of the output ports, with the pulses output from each of the output ports being distinguished from one another, and responsive to absence of receipt of pulses from any of the output ports via the electrically-conductive tracks to provide an indication of occurrence of damage to the wall.

2. Packaging as claimed in claim 1, wherein electrical pulses output from different ones of the output ports are distinguished by an output timing of the pulses, and the electronic control circuit is responsive to the output timing of the pulses to determine the respective ones of the output ports from which received pulses are output.

3. Packaging as claimed in claim 1, wherein electrical pulses output from different ones of the output ports are distinguished by coding of the pulses, and the electronic control circuit is responsive to the coding of the pulses to determine the respective ones of the output ports from which received coded pulses are output.

4. Packaging as claimed in claim 1, wherein the second ends of the electrically-conductive tracks are connected to a conductive strip at locations spaced along a length of the conductive strip and a further electrically-conductive track connects the conductive strip to the input port.

5. Packaging as claimed in claim 4, wherein the conductive strip extends adjacent an edge of the wall.

6. Packaging as claimed in claim 1, including a plurality of groups of electrically-conductive tracks, and wherein the electronic control circuit includes a corresponding plurality of groups of output ports and a corresponding plurality of input ports.

7. Packaging as claimed in claim 1, wherein the electronic control circuit includes a memory unit, and is operative in response to absence of receipt of a pulse to write data into the memory unit indicative of absence of receipt of the pulse.

8. Packaging as claimed in claim 7, wherein the electronic control circuit includes an interface for communication with an external device.

9. A package handling system for handling packages including packaging as claimed in claim 8, including a communications unit operative to communicate with the electronic control circuits of the packages via the respective interfaces during passage of the packages through the package handling system.

10. Packaging as claimed in claim 1, wherein the wall is formed of an electrically-insulating material and the electrically-conductive tracks are deposited on a surface of the wall.

11. Packaging as claimed in claim 10, wherein the electronic control circuit is formed by deposition on the surface of the wall.

12. A mailing envelope comprising packaging as claimed in claim 1.

13. A blank, comprising:

a sheet of paper or cardboard bearing a group of electrically-conductive tracks extending over the sheet, each including a first end and a second end opposite the first end; and an electronic control circuit secured to the sheet and including a group of first, output ports and a second, input port, the output ports being connected to respective ones of the first ends of the electrically-conductive tracks and the input port being connected to the second ends of the electrically-conductive tracks;

wherein the electronic control circuit is operative to output electrical pulses from each of the output ports, with the pulses output from each of the output ports being distinguished from one another, and responsive to absence of receipt of pulses from any of the output ports via the electrically-conductive tracks to provide an indication of occurrence of damage to the sheet.

* * * * *